US006006382A

United States Patent [19]

Smith

[11] Patent Number: 6,006,382

[45] Date of Patent: Dec. 28, 1999

[54] BED FRAME INSERT

[76] Inventor: Jerome P. Smith, 109 Hanover St., New Oxford, Pa. 17350

[21] Appl. No.: 09/302,300

[22] Filed: Apr. 30, 1999

Related U.S. Application Data

[60] Provisional application No. 60/083,587, Apr. 30, 1998.

[51] Int. Cl.[6] ..... A61G 7/00; A47C 21/00

[52] U.S. Cl. ..... 5/660; 5/509.1; 5/310

[58] Field of Search ..... 5/660, 509.1, 610, 5/310, 200.1, 201

[56] References Cited

U.S. PATENT DOCUMENTS

| | | | |
|---|---|---|---|
| Re. 26,411 | 6/1968 | Alsobrook, Jr. | 5/660 |
| 3,745,597 | 7/1973 | Kurtz | 5/510 |
| 3,803,644 | 4/1974 | Harris | 5/181 |
| 3,995,334 | 12/1976 | Harris | 5/200.1 |
| 4,007,502 | 2/1977 | Mia | 5/202 |
| 4,312,088 | 1/1982 | Webb | 5/509.1 |
| 4,715,073 | 12/1987 | Butler | 5/509.1 |
| 4,856,129 | 8/1989 | Butler | 5/509.1 |
| 5,205,005 | 4/1993 | Merrill et al. | 5/660 |
| 5,243,726 | 9/1993 | Bisbee | 5/610 |
| 5,592,709 | 1/1997 | Watkins | 5/660 |

*Primary Examiner*—Alexander Grosz
*Attorney, Agent, or Firm*—Sixbey, Friedman, Leedom & Ferguson, P.C.; Charles M. Leedom, Jr.; Daniel S. Song

[57] ABSTRACT

A bed frame insert for attachment to a conventional bed frame to allow a bed supported on the bed frame insert to be selectively positioned from a horizontal position to an inclined position. The bed frame insert includes a pair of side frame members for supporting the bed which are pivotably mountable to a first end of the conventional bed frame. The bed frame insert also includes a forward cross frame member extending between the pair of side frame members, a mattress restraining member positioned on the bed frame insert proximate to the first end of the conventional bed frame and at least two leg members adapted to incline the bed frame insert relative to the conventional bed frame by pivoting the bed frame insert. To accommodate beds of different widths, the forward cross frame member and the mattress restraining member may be transversely adjustable. The mattress restraining member acts to prevent longitudinal movement of the mattress when the bed frame is in an inclined position. Moreover, the leg members may be adjustable to selectively adjust the angle of inclination of said bed frame insert relative to the conventional bed frame. In addition, leg members may be provided with a leg collar which usable to prevent the conventional bed frame from becoming elevated off the floor when the bed frame insert is used. Each of the side frame members may include a plurality of bed engaging members for engaging the bed supported on the bed frame insert to restrict lateral movement of the bed.

23 Claims, 3 Drawing Sheets

BED FRAME INSERT

This application claims the benefit of U.S. Provisional Application No. 60/083,587 filed Apr. 30, 1998.

BACKGROUND OF THE INVENTION

1. Field of the Invention

This invention generally relates to bed elevating devices and more particularly to bed frame inserts which convert a conventional bed frame into a bed frame that permits the mattress and box spring to be selectively positioned from a horizontal position to an inclined position.

2. Description of the Related Art

The therapeutic and medical benefits provided from the use of inclined beds are widely known. One need only survey the number of such beds in a hospital or other medical facility to appreciate the recognized value they supply to the medical community. Hospital patients suffering from hiatal hernias, congestive heart problems, respiratory and stomach difficulties all experience less discomfort when they rest or sleep in a longitudinally inclined position with their heads elevated. Alternatively, patients suffering from phlebitis or varicose veins can benefit from sleeping with their feet and legs elevated. When these conditions are diagnosed, the patient often is required to at least temporarily remain in a hospital where access to the specialized equipment is provided. However, when a homebound patient requires this equipment, the financial burden of providing an inclined sleeping surface frequently must be borne by the patient. This can be particularly troubling for those living with a fixed income. A prior art inclined bed frame capable of being utilized with a conventional bed is disclosed in U.S. Pat. No. 5,243,726 to Bisbee. This reference discloses a stand-alone bed frame that is capable of also maintaining a mattress and box spring in an inclined position. For the individual who seeks to take maximum advantage of his/her existing bed frame while minimizing their costs, the device in Bisbee would be unattractive since its purchase would result in the undesirable surplusage of a completely functional bed frame. What is needed is a device that can be used with an existing conventional bed frame that allows the bed frame to be converted into one that will provide an incline capability.

In the past, inventors have attempted to solve this problem by designing various devices that modify standard beds to provide the desired angular adjustment. For example, U.S. Pat. No. 4,312,088 to Webb discloses a portable bed adjusting device for patients wherein bed elevating blocks are inserted under one end of the bed. To secure the mattress against longitudinal movement when the bed is inclined, this device also utilizes a plurality of mattress retainers. These mattress retainers are positioned between the mattress and box springs. They are comprised of two separable, longitudinally aligned, L-shaped elements, each having a relatively long leg with a perpendicular short leg. The two elements are detachably secured together in longitudinal alignment to a provide a single, generally rectilinear mattress restraining member wherein the short legs constitute grips to maintain the mattress in place relative to the mattress support or box springs. This particular approach to inclining the mattress and box springs is impractical for several reasons. First, placing blocks underneath the legs of a bed will likely create a very unstable and potentially disruptive sleeping surface especially if the bed is accidentally jostled or if the blocks somehow become misaligned. Also, Webb's concept for restricting motion of the mattress relative to the mattress support ignores the fact that most conventional bed frames are not capable of restricting movement of the box springs when the bed is in an inclined position. Therefore, the box springs will likely shift when the bed is inclined, causing the mattress to shift as well.

U.S. Pat. No. 5,592,709 to Watkins also discloses a bed elevating apparatus wherein the lower surface of the apparatus is supportable on a conventional bed frame. The apparatus is a triangularly-shaped beam, adapted to fit on the side rail of a conventional bed frame. In use, the box spring is lifted, and the apparatus is placed on the ledges beneath the box spring in the desired longitudinal position. To increase or decrease the inclination of a mattress, a user need only slide the apparatus toward or away from the center of the mattress. This reference however, fails to disclose how this device remains stationary once a box spring is placed on it. Watkins also does not disclose the capability of this device to prevent the mattress and/or box spring from inadvertently shiffing in the longitudinal direction when one end of the mattress is inclined. Furthermore, this reference fails to disclose any capability of this device to accommodate different sized beds. A similar device is disclosed in U.S. Pat. No. 5,205,005 to Merrill et al. That reference discloses a bed elevating apparatus wherein a box spring and mattress is supportable on the upper surface of a triangularly-shaped plane. The device extends substantially in a single angularly extending plane for supporting one end of the mattress at an elevation higher than an opposite end of the mattress. As in the previous case, the lower surface of the apparatus is supportable on a conventional bed frame. This reference also fails to disclose the capability of this device to prevent the mattress and/or box spring from inadvertently shifting in the longitudinal direction when the mattress is inclined. It also fails to disclose any capability to accommodate different sized beds.

U.S. Pat. No. Re. 26,411 to Alsobrook likewise discloses a tilting accessory for a standard bed wherein the box springs and mattress can be tilted to an inclined position. This device is placed on a conventional Hollywood bed frame and utilizes an operating lever to apply torque to a connecting rod, which in turn provides the lifting force causing a secondary frame to pivot around a transverse axis and rise above the primary frame. This reference however, fails to disclose a capability to prevent the apparatus from being accidentally or unintentionally lowered. Also, the reference does not disclose the capability of this device to be secured to a bed frame which would provide increased stability of the sleeping surface when it is in its inclined position. It also fails to disclose a simple way to change the maximum inclination achievable by the device. This reference further does not disclose the capability of this device to prevent the mattress from shifting toward the lower end of the bed when the mechanism is in its inclined position. Also, the relatively complex design of this device and its associated expense defeats the advantage of utilizing a bed frame attachment to modify a conventional Hollywood bed frame so that excessive complexity and expense associated with the typical inclined bed can be avoided.

SUMMARY OF THE INVENTION

Accordingly, one object of the present invention is to provide a bed frame insert that allows a user to convert a conventional bed frame into a bed frame that will permit the user to selectively position the mattress and box spring from a horizontal position to an inclined position.

It is another object of the present invention to provide a bed frame insert that will allow a user to alter the width of the bed frame insert to accommodate different size mattresses.

It is still another object of the present invention to provide a bed frame insert that will accommodate mattresses of varying lengths.

It is yet another object of the present invention to provide a bed frame insert that will securely maintain the mattress and box spring remain in place when the bed is in an inclined position.

These and other more specific objects and advantages of the subject invention are obtained by a bed frame insert for attachment to a conventional bed frame to allow a bed supported on the bed frame insert to be selectively positioned from a horizontal position to an inclined position. In accordance with one embodiment, a bed frame insert in accordance with the present invention includes a pair of side frame members for supporting the bed which are pivotably mountable to a first end of the conventional bed frame. The bed frame insert also includes a forward cross frame member extending between the pair of side frame members, a mattress restraining member positioned on the bed frame insert proximate to the first end of the conventional bed frame and at least two leg members adapted to incline the bed frame insert relative to the conventional bed frame by pivoting the bed frame insert. The mattress restraining member acts to prevent longitudinal movement of the mattress when the bed frame is in an inclined position. In alternative embodiments of the present invention, the side frame members may include a plurality of longitudinally-spaced holes adapted to receive a bolt for pivotally mounting each of the side frame members to the conventional bed frame and to allow adjustable mounting based on the bed length. In addition, the forward cross frame member and the mattress restraining member may be transversely adjustable to accommodate beds of different widths. In this regard, the mattress restraining member may include a left mattress restraining member and a right mattress restraining member slidably receivable within the left mattress restraining member to accommodate beds of varying width. Moreover, the leg members may be adjustable to selectively adjust the angle of inclination of said bed frame insert relative to the conventional bed frame. In this regard, the leg members may include a top leg portion with a height adjustment hole for receiving a securing peg, and a bottom leg portion slidably receivable in the top leg portion. The bottom leg portion may include a plurality of longitudinally-spaced through holes for receiving the securing peg and the position of the bottom leg portion is fixed relative to the top leg portion by inserting the securing peg through the height adjustment hole and one of the plurality of longitudinally-spaced through holes. The bed frame insert may also be provided with a plurality of securing brackets adapted to secure each of the leg members to either the side frame member or the forward cross frame member. In addition, in another embodiment, each of the two leg members proximate to the side frame members may be provided with a leg collar which is movably attached to the top leg portion and which includes a flange to prevent the conventional bed frame from becoming elevated off the floor when the bed frame insert is used. Furthermore, the side frame members may include a plurality of bed engaging members for engaging tie bed supported on the bed frame insert to restrict lateral movement of the bed.

These and other objects, features and advantages of the present invention will become more apparent from the following detailed description of the invention when viewed in conjunction with the accompanying drawings.

DETAILED DESCRIPTION OF THE INVENTION

In the following detailed description of the preferred embodiment, reference is made to the accompanying drawings which shows a specific embodiment in which the invention may be practiced. While this embodiment is described in sufficient detail to enable those skilled in the art to practice the invention, it is to be understood that other embodiments may be utilized and that structural changes may be made without departing from the scope of the present invention. The following detailed description is, therefore, not to be taken in a limited sense.

Figure 1:
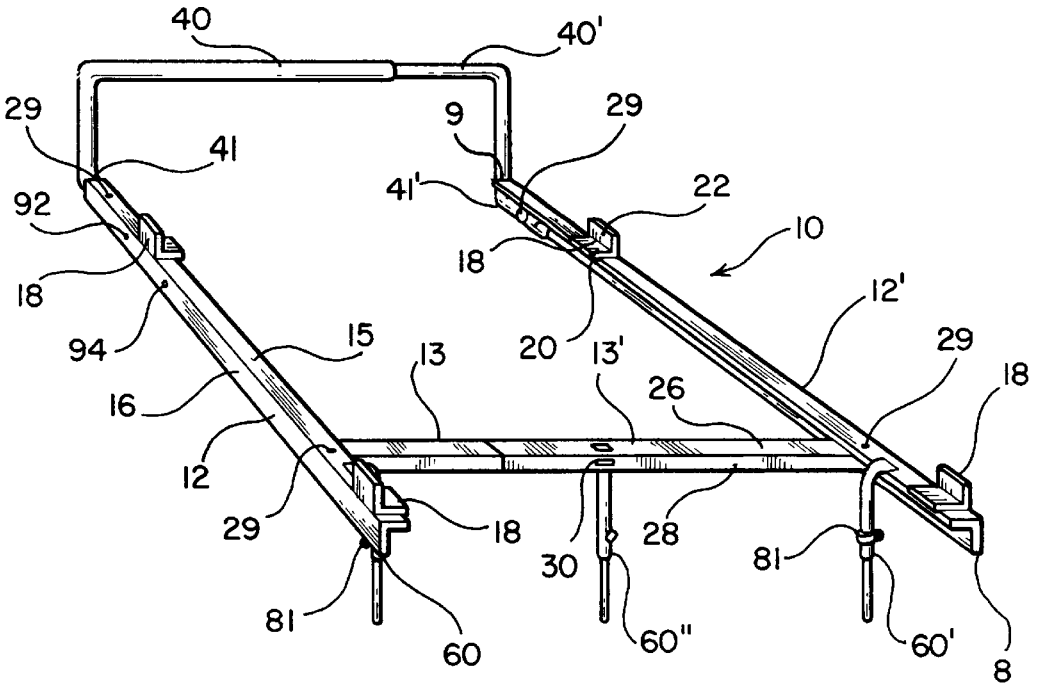
FIG. 1 is a perspective view of one embodiment of the bed frame insert in accordance with one embodiment the present invention.

Referring now to the drawings in detail, a bed frame insert 10 in accordance with one embodiment of the present invention is shown in FIG. 1 comprising a pair of side frame members 12 and 12' which are spaced parallel with respect to one another and spanned by forward cross frame members 13 and 13'. The bed frame insert 10 is also comprised of mattress restraining members 40 and 40' which together act to restrict the longitudinal movement of a mattress when the bed frame insert 10 is in an inclined position. The bed frame insert 10 further comprises a plurality of leg members 60, 60' and 60" to elevate one side of the bed frame insert 10 relative to an attached conventional frame (not shown). The left leg member 60 and right leg member 60' are also provided with leg collars 81 which may be used in a manner described below to prevent the conventional bed frame from becoming elevated off the floor when the bed frame insert 10 is used. As can be seen, the left side frame member 12 and right side frame member 12' are elongated, generally L-shaped angle iron members, each having a front end 8, a rear end 9, horizontal surface 15 and vertical surface 16. In the illustrated embodiment, each side frame member 12 and 12' is approximately 2"×1½"×75". Secured to the horizontal surface 15 of each of the side frame members 12 and 12' are two bed engaging members 18. As seen in FIG. 1, one bed engaging member 18 is secured in spaced relation to each end of the left and right side frame members 12 and 12'. Each bed engaging member 18 is a generally L-shaped metal tab comprised of a horizontal surface 20 adapted to receive on the a box spring and a mattress, and a vertical surface 22 adapted to confine the box spring on the horizontal surface 15 of each side frame members 12 and 12'. In a preferred embodiment, horizontal surface 20 of each bed engaging member 18 is approximately 3" long and vertical surface 22 is approximately ½" high. Referring again to FIG. 1, forward cross frame members 13 and 13' have a horizontal surface 26 and vertical surface 28. In a preferred embodiment, each forward cross frame member is approximately 1¼" (H)× 1¼"(W)×32½"(L). The forward cross frame members 13 and 13' are secured to side frame members 12 and 12' respectively at approximately 19" from the front end 8 with a rivet or other fastening means 29 that first extends through the horizontal surface 15 of each side frame member and into the horizontal surface 26 of each cross frame member 13 and 13'. When secured to their corresponding side frame members, the forward cross frame members 13 and 13' are free to pivot for easy assembly/disassembly and storage.

Figure 2:
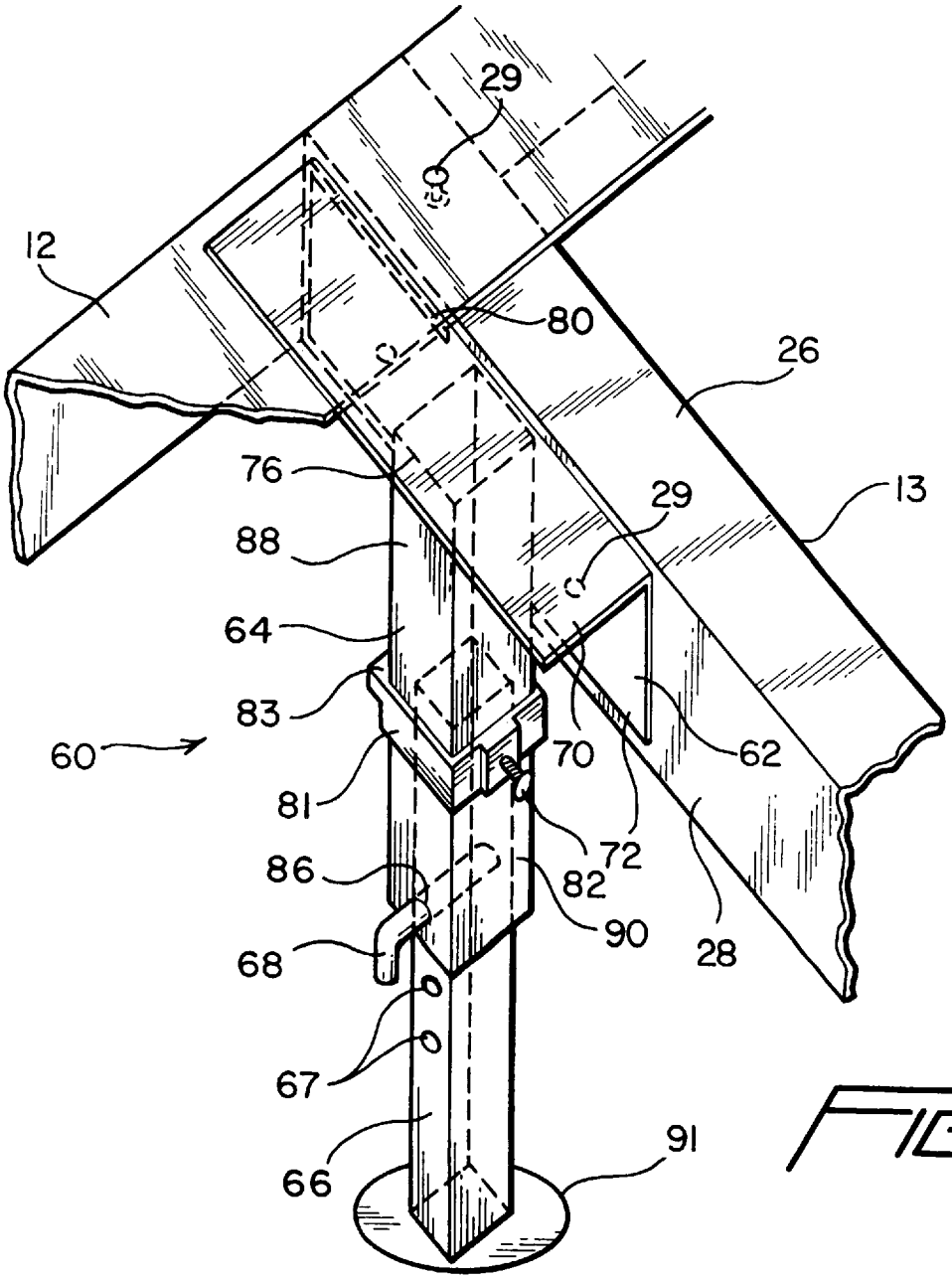
FIG. 2 is an enlarged perspective view of the left leg member of the bed frame insert of FIG. 1.

An enlarged perspective view of the left leg member 60 is shown in FIG. 2. In a preferred embodiment, the bed frame insert is comprised of left, right and center leg members 60, 60' and 60" respectively, each having generally similar structure and operated in a similar manner described hereinbelow. As seen in FIG. 2, each leg member 60 is comprised of a securing bracket 62, a top leg portion 64 a bottom leg portion 66 and a securing peg 68. The securing bracket 62 as shown is comprised of a 3 inch long L-shaped angle iron member, similar to that used for the side frame and cross frame members. The vertical surface 72 of the securing bracket 62 is placed in abutting relationship with the vertical surface 28 of the corresponding forward cross frame member 13 such that the L-shaped securing bracket 62 is facing in a direction opposite to that of the L-shaped forward cross frame member 13. As shown in FIG. 2, the securing bracket 62 is secured to the forward cross frame member 13 by fastening means 29 so that the cross frame member 26 can be pivoted to a position perpendicular to the side frame member 12. In this regard, the securing bracket 62 includes a slot 80 on the vertical surface 72 for receiving the horizontal surface 15 of the left side frame member 12. In addition, the left leg member 60 may be provided with a collar ring 81 which is movably attached to the top leg portion 64 by a threaded thumb screw 82. As will be discussed in further detail below, the collar ring 81 includes a flange 83 which engages the conventional bed frame and prevents the conventional bed frame from becoming elevated off the floor when the bed frame insert 10 is used.

In a similar manner, the right leg member 60' (not shown) is secured to the right cross frame member 13' which can be pivoted to a position perpendicular to the side frame member 12'. The right leg member 60' may also be provided with a collar ring 81 to prevent elevation of the conventional bed frame. The center leg member 60" (not shown) is secured to the right cross frame member 13' with fastening means such as a rivet (not shown) in spaced relation to the right leg member 60' such that when the width of the bed frame insert is substantially equal to the width of a queen size bed, the center leg member 60" is positioned at the midpoint of the assembled frame. Of course, it should be appreciated that whereas in the illustrated embodiment, the leg members 60, 60' and 60" are secured to the cross frame members 13 and 13', in alternative embodiments of the present invention, the leg members 60 and 60' may be secured to the side frame members 12 and 12'.

In the illustrated embodiment, the top leg portion 64 is a 1" square metal tube approximately 9 inches long. At approximately 1 inch from the bottom of the top leg portion, a height adjustment hole 86 is formed in an outside face 88 of the top leg portion 64 which extends completely through outside face 88 and its opposing inside face 90. The uppermost portion 76 of the top leg portion 64 is positioned in surface abutting relationship with the top of the securing bracket 62 and is welded to the securing bracket 62 by a bead line 82 which preferably extends along at least two sides of the top leg portion 64 such that the leg portion 64 extends substantially perpendicular with respect to the top of the securing bracket 62.

The bottom leg portion 66 in the illustrated embodiment is a ¾" square metal tube insert approximately 7⅞" long which fit within the top leg portion 64. As shown in FIG. 2, through holes 67 similar to those found in the top leg portion 64 are formed in the bottom leg portion 66, starting at approximately 1" from the bottom with successive holes proceeding longitudinally up the bottom leg portion 66, each hole being spaced approximately 1½" apart from one another. As shown in FIG. 2, the bottom leg portion 66 is smaller in cross section than the top leg portion 64 and is slidably receivable therein to provide an effective length of 8–12½" for each leg member 60, 60' and 60" when a securing peg 68 is slidably inserted through the aligned height adjustnent hole 86 in the top leg portion 64 and the through holes 67 in the bottom leg portion 66. A protective plastic cap 91 may also be provided on an end of the bottom leg portion 66. The leg members 60, 60' and 60" support the bed frame insert 10 by directly contacting and being supported by the ground surface. This allows the bed frame insert to maintain a low center of gravity and stabilizes the bed so as to avoid instability and wobbling of the bed. It should also be noted that whereas leg members having a square tube shape are illustrated and discussed, leg members having a circular tube shape may also be used. Moreover, the leg members may also be non-telescoping. Of course the leg members may be circular in cross section in another embodiment which can function in a like manner as disclosed above.

Referring again to FIG. 1, the left mattress restraining member 40 may be a 1" square metal tube approximately 60" long. The right mattress restraining member 40' may be a ¾" square metal tube approximately 60" long. As shown in FIG. 1, each of the mattress restraining members 40 and 40' include lower segments 41 and 41' respectively that allows the mattress restraining members 40 and 40' to be attached to the side frame members 12 and 12' respectively. Because of the smaller cross section, the right mattress restraining member 40' is slidably receivable within the left mattress restraining member 40 to provide an effective combined sizeable length of 42–78". Of course, it should be appreciated that the present embodiment provides two mattress restraining members 40 and 40' to allow adjustability so that the bed frame insert 10 may be used with different sized beds. In alternative embodiments, the mattress restraining member may be a single unit of fixed dimension which can be mounted to the side frame members 12 and 12' in a similar manner. Moreover, in either of these embodiments, the mattress restraining member(s) may be made of circular tubes or other tubes as well.

Figure 3:
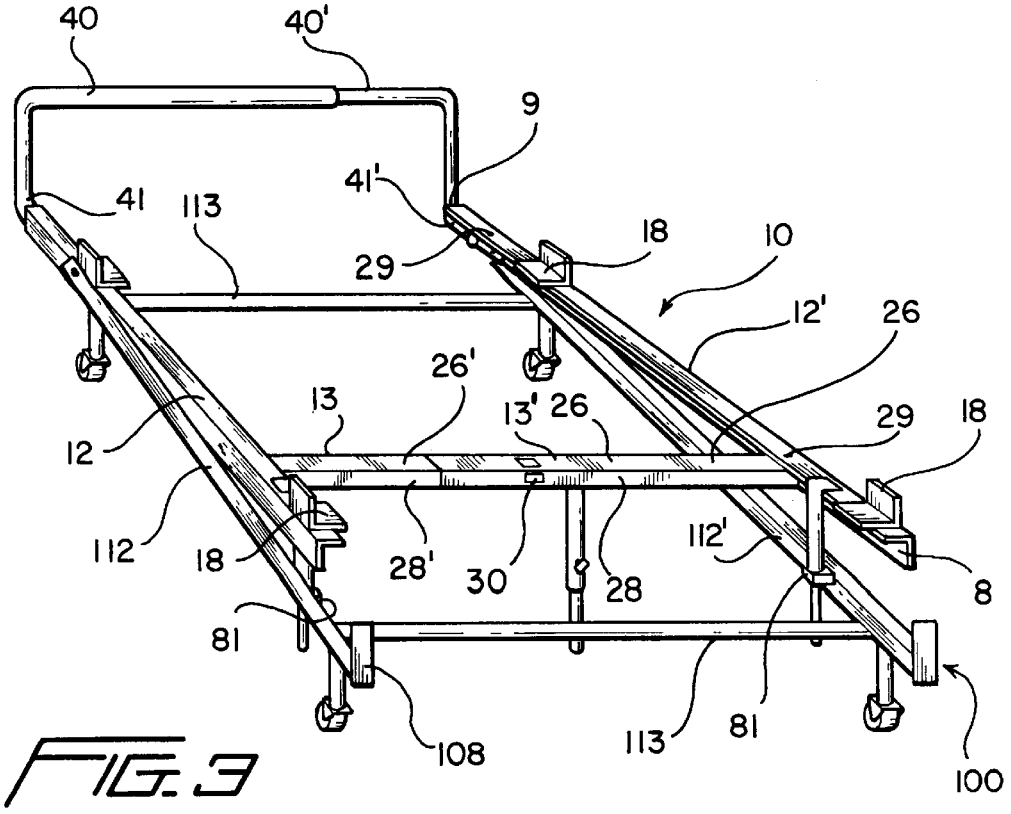
FIG. 3 is a perspective view of the present invention installed on a conventional bed frame and placed in an inclined position.
Figure 4:
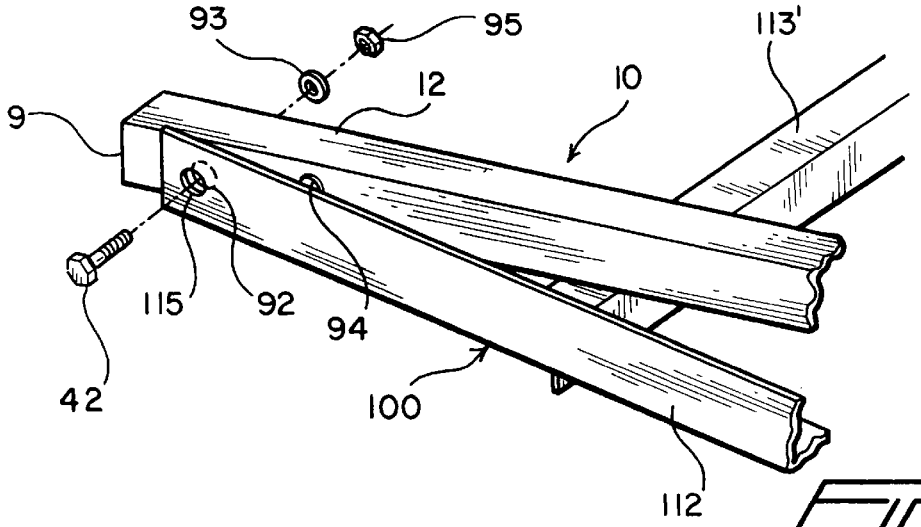
FIG. 4 is a perspective view of how the present invention is installed.

In use, the bed frame insert 10 is coupled to a conventional bed frame 100 as shown in FIG. 3 such as a Hollywood bed frame by first placing the left side frame member 12 adjacent to the corresponding left side frame member 112 of the bed frame 100 such that the front end 8 of the left side frame member 12 is proximate to the head end 108 of the conventional bed frame 100. The right side frame member 12' is placed adjacent to the corresponding right side frame member 112' of the bed frame 100 with the front end 8 of the right side frame member 12' proximate to the head end 108 of the bed frame 100. The left and right side frame members 12 and 12' are then positioned such that the leg members 60 and 60' are placed between the corresponding cross frame members 113 and 113' of the bed frame 100. As seen in FIG. 4, there are two attachment holes 92 and 94 located approximately 6 and 11 inches from the rear end 9 of each side frame member 12 and 12' of the bed frame insert 10 for attaching the bed frame insert 10 to a conventional bed frame 100. The attachment holes 92 and 94 of the bed frame insert 10 as well as the boles 115 which are typically provided in conventional bed frames, receive bolt 42 which pivotably mounts the bed frame insert 10 to the bed frame 100. Whether hole 92 or 94 is used depends on the length of the box spring and mattress to be support. For instance, if a "queen" size bed is to be supported, hole 92 would be used whereas if a "twin" size bed is to be supported, hole 94 would be used. A properly sized washer 93 and nut 95 is threaded onto bolt 42 to secure the bed frame insert 10 to the bed frame 100. As shown in FIG. 3, the forward cross frame members 13 and 13' are pivoted and then secured together using a clamping means 30 to prevent additional lateral movement. The right mattress restraining member 40' is slidingly inserted into the left mattress restraining member 40 and the lower segments 41 and 41' of the mattress restraining members 40 and 40' respectively are secured to the left and right side frame members 12 and 12'. This is attained by placing the left and right lower segments 41 and 41' in face-abutting relationship to the left and right side frame members 12 and 12' and securing them with a clamping means thereby preventing additional longitudinal and lateral motion by the mattress restraining members 40 and 40'.

Figure 5A:
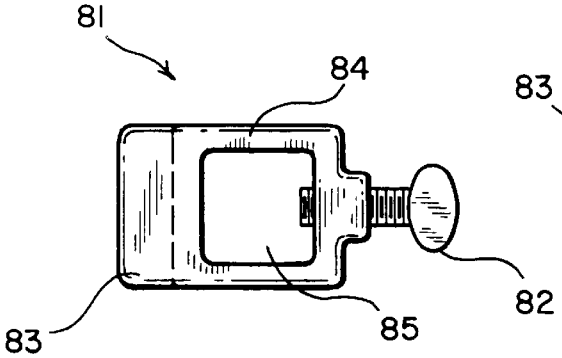
FIG. 5*a* is a top view of the leg collar in accordance with one embodiment of the present invention.
Figure 5B:
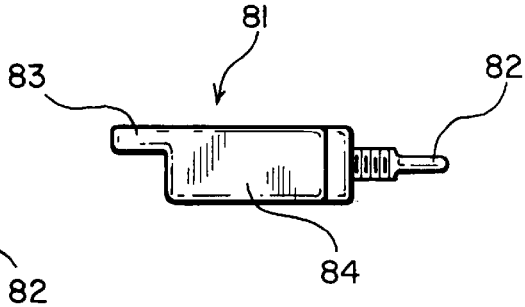
FIG. 5*b* is a side view of the leg collar of FIG. 5*a*.

When the bed frame insert 10 is installed with a mattress and box spring (both not shown) on a conventional bed frame, securing pegs 68 are placed in the aligned holes 86 and 67 of the left, right and middle leg members 60, 60' and 60" respectively so that the bed frame insert 10 is maintained at a desired inclined position. Also, when the bed frame insert 10 is positioned such that the mattress and box spring are inclined, left and right mattress restraining members 40 and 40' respectively, prevents the mattress and box spring from shifting. It has been found that when the bed frame insert 10 is attached to the conventional bed frame 100 as shown in FIG. 4, the one end (head end) of the conventional bed frame 100 may become elevated off the floor since the weight of the mattress and box spring is no longer acts upon the conventional bed frame 100 at the head end. To prevent this elevation of the head end of the conventional bed frame 100, the left leg member 60 and the right leg member 60' may be provided with collar rings 81 as shown in FIGS. 5*a* and 5*b*. As previously noted, the collar rings 81 may each be movably attached to the top leg portion 64 of the leg member by a threaded thumb screw 82 which engages the top leg portion 64 through a threaded hole (not shown) in the collar ring body 84. As can be clearly seen in FIG. 5*a*, the collar ring body 84 includes an opening 85 to allow the collar ring 81 to be installed on the top leg portion 64 via the threaded thumb screw 82. Of course, the size and shape of the opening 85 should generally correspond to the size and shape of the top leg portion 64 so if the top leg portion 64 was circular, the opening 85 may also be circular. As better illustrated in FIG. 5*b*, the collar ring 81 includes a flange 83 which extends from the collar ring body 84 and is properly dimensioned such that when the collar ring 81 is installed, the flange 83 engages the conventional bed frame 100 such as its side frame members 112 and 112' and prevents the conventional bed frame 100 from becoming elevated off the floor when the bed frame insert 10 is used. Thus, in the present embodiment of the present invention, the exterior dimensions of the collar ring body 84 may be approximately 0.5"(H)×1.375"(W)×2"(L) and may be formed of a metal such as aluminum, iron or steel. The general installation and use of the collar rings 81 are shown in FIG. 3.

While this specification includes many details and specificities, these are only included for illustration and are not intended to limit the invention. Many modifications to the examples described above will be readily apparent to those of ordinary skill in the art which do not depart from the scope of the invention as defined by the following claims and their legal equivalents.

Industrial Applicability

The bed frame insert of the present invention may be used to convert a conventional bed frame into an inclined bed frame. Also, the bed frame insert may be used where it is desirable to provide an inclined bed frame that prevents inadvertent movement of a mattress when the bed frame is in an inclined position. Furthermore, the bed frame insert may be used where it is desirable to provide a bed frame insert that allows a user to easily and securely incline a mattress to various inclined positions for rehabilitative sleep.

We claim:

1. A bed frame insert for attachment to a conventional bed frame to allow a bed supported on said bed frame insert to be selectively positioned from a horizontal position to an inclined position, said bed frame insert comprising:

a pair of side frame members for supporting the bed, said pair of side frame members pivotably supported at a first end of the conventional bed frame;

a forward cross frame member extending between said pair of side frame members;

a mattress restraining member positioned on said bed frame insert proximate to the first end of the conventional bed frame; and at least two leg members secured to at least one of said pair of side frame members and said forward cross frame member, said at least two leg members adapted to contact and be supported by an adjacent floor, said at least two leg members being adapted to incline said bed frame insert relative to the conventional bed frame.

2. Bed frame insert of claim 1, wherein said forward cross frame member extends perpendicularly between said pair of side frame members.

3. Bed frame insert of claim 2, wherein each of said pair of side frame members include a plurality of longitudinally-spaced holes adapted to receive a bolt for pivotally mounting each of said side frame members to the conventional bed frame.

4. Bed frame insert of claim 2, wherein said forward cross frame member is an adjustable frame member adapted to extend perpendicularly and transversely between said side members to accommodate mattresses of varying width.

5. Bed frame insert of claim 4, wherein said at least two leg members are adjustable to selectively adjust the angle of inclination of said bed frame insert relative to the conventional bed frame.

6. Bed frame insert of claim 5, wherein said mattress restraining member extends substantially perpendicular to a plane defined by said pair of side frame members and said forward cross frame member thereby restricting longitudinal movement of the bed relative to said bed frame insert when said bed frame insert is in an inclined position.

7. Bed frame insert of claim 6, wherein each of said at least two leg members comprise:

a top leg portion with a height adjustment hole for receiving a securing peg; and a bottom leg portion slidably receivable in said top leg portion, said bottom leg portion including a plurality of longitudinally-spaced through holes for receiving said securing peg;

wherein position of said bottom leg portion is fixed relative to said top leg portion by inserting said securing peg through said height adjustment hole and one of said plurality of longitudinally-spaced through holes.

8. Bed frame insert of claim 7, wherein said mattress restraining member comprises a left mattress restraining member and a right mattress restraining member slidably receivable within said left mattress restraining member to accommodate beds of varying width.

9. Bed frame insert of claim 8, further comprising a leg collar mountable to one of said at least two leg members for preventing elevation of the conventional bed frame.

10. Bed frame insert of claim 9, wherein said leg collar includes an opening for receiving one of said at least two leg members, a thumb screw for engaging said one of said at least two leg members, and a flange for engaging the conventional bed frame.

11. Bed frame insert of claim 10, wherein each of said side frame members includes a plurality of bed engaging members for engaging the bed supported on said bed frame insert to restrict lateral movement of the bed.

12. Bed frame insert of claim 11, farther comprising a plurality of securing brackets adapted to secure each of said at least two leg members to at least one of said side frame member and said forward cross frame member.

13. Bed frame insert of claim 1, wherein said at least two leg members are adjustable to selectively adjust the angle of inclination of said bed frame insert relative to the conventional bed frame.

14. Bed frame insert of claim 13, wherein each of said at least two leg members comprise:

a top leg portion with a height adjustment hole for receiving a securing peg; and a bottom leg portion slidably receivable in said top leg portion, said bottom leg portion including a plurality of longitudinally-spaced through holes for receiving said securing peg;

wherein position of said bottom leg portion is fixed relative to said top leg portion by inserting said securing peg through said height adjustment hole and one of said plurality of longitudinally-spaced through holes.

15. Bed frame insert of claim 1, further comprising a leg collar mountable to one of said at least two leg members for preventing elevation of the conventional bed frame.

16. Bed frame insert of claim 1, wherein said mattress restraining member extends substantially perpendicular to a plane defined by said pair of side frame members and said forward cross frame member and also extends transversely between said side frame members thereby restricting longitudinal movement of the bed relative to said bed frame insert when said bed frame insert is in an inclined position.

17. Bed frame insert of claim 16, wherein said mattress restraining member comprises a left mattress restraining member and a right mattress restraining member slidably receivable within said left mattress restraining member to accommodate beds of varying width.

18. Bed frame insert of claim 1, wherein each of said side frame members includes a plurality of bed engaging members for engaging the bed supported on said bed frame insert to restrict lateral movement of the bed.

19. Bed frame insert of claim 1, wherein said forward cross frame member is an adjustable frame member adapted to extend transversely between said side members to accommodate mattresses of varying width.

20. Bed frame insert of claim 1, further comprising a plurality of securing brackets adapted to secure each of said at least two leg members to at least one of said side frame member and said forward cross frame member.

21. A bed frame insert for converting a conventional bed frame into a inclinable bed frame that permits a mattress mounted thereon to be selectively positioned from a horizontal to an inclined position, said bed frame insert comprising:

a pair of side frame members for supporting a bed;

a forward cross frame member interconnecting each of said pair of side frame members to one another proximal to a head end of said pair of side frame members;

a mattress restraining member connected to a foot end of said pair of opposing spaced side frame members, said mattress restraining member extending substantially perpendicular to a plane defined by said pair of side frame members and said forward cross frame member thereby restricting longitudinal movement of the bed relative to said bed frame insert when said bed frame insert is in an inclined position; and a plurality of leg members adapted to contact and be supported by an adjacent floor, said leg members being attached to at least one of said pair of side frame members and said forward cross frame member;

wherein said leg members are adjustable to vary the inclination of said pair of side frame members with respect to a horizontal plane.

22. A bed frame insert of claim 21, wherein said forward cross frame member and said mattress restraining member are transversely adjustable to accommodate beds of different sizes.

23. A bed frame insert of claim 22, wherein each of said pair of side frame members include a plurality of longitudinally-spaced holes adapted to receive a bolt for pivotally mounting each of said side frame members to the conventional bed frame and a plurality of bed engaging members for engaging the bed supported on said bed frame insert to restrict lateral movement of the bed.

* * * * *